US009887490B2

(12) United States Patent
Matsuura et al.

(10) Patent No.: US 9,887,490 B2
(45) Date of Patent: Feb. 6, 2018

(54) CONNECTOR WITH ERRONEOUS ARRANGEMENT IDENTIFYING PORTION

(71) Applicant: Sumitomo Wiring Systems, Ltd., Yokkaichi, Mie (JP)

(72) Inventors: Masahito Matsuura, Mie (JP); Toshihiro Ito, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/603,828

(22) Filed: May 24, 2017

(65) Prior Publication Data

US 2017/0365950 A1 Dec. 21, 2017

(30) Foreign Application Priority Data

Jun. 17, 2016 (JP) ..... 2016-120497

(51) Int. Cl.
*H01R 13/514* (2006.01)
*H01R 13/627* (2006.01)
*H01R 13/64* (2006.01)

(52) U.S. Cl.
CPC ..... *H01R 13/6271* (2013.01); *H01R 13/64* (2013.01)

(58) Field of Classification Search
CPC ..... H01R 13/4362
USPC ..... 439/752
See application file for complete search history.

(56) References Cited

U.S. PATENT DOCUMENTS

2009/0081908 A1* 3/2009 Martin ..... H01R 13/4223 439/752
2010/0062660 A1* 3/2010 Itou ..... H01R 13/4362 439/752

FOREIGN PATENT DOCUMENTS

JP 2000-067980 3/2000

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A retainer (60) includes locking protrusions (66) projecting toward side surfaces of a housing (10). A resilient wall (18) defining a mounting hole (17) and including a part capable of interfering with the locking protrusion (66) is disposed on the side surface of the housing (10). The resilient wall (18) includes a lock receiving portion for lockably receiving the locking protrusion (66) by resilient return. An erroneous arrangement identifying portion (27) is disposed on an inner surface of the mounting hole (17) of the housing (10) for restricting an erroneous arrangement of the retainer (60) into the mounting hole (17). The erroneous arrangement identifying portion (27) is a rib-like part provided on the resilient wall (18).

4 Claims, 12 Drawing Sheets

CONNECTOR WITH ERRONEOUS ARRANGEMENT IDENTIFYING PORTION

BACKGROUND

1. Field of the Invention

The invention relates to a connector.

2. Description of the Related Art

Japanese Unexamined Patent Publication No. 2000-67980 discloses a connector with a housing for accommodating terminal fittings and a retainer for secondarily locking the terminal fittings. A mounting hole is open in a lower surface of the housing and communicates with cavities for the terminal fittings. The retainer is inserted into the mounting hole from the lower surface of the housing and is movable between a partial locking position where the terminal fittings are insertable into the cavities and a full locking position where the terminal fittings are retained in the cavities.

The housing has a resilient wall that defines a side surface of the mounting hole. The resilient wall has a partial locking hole that communicates with the mounting hole. A partial locking projection of the retainer is inserted into the partial locking hole to hold the retainer at the partial locking position.

In the process of the retainer reaching the partial locking position, the partial locking projection slides on an inner surface of the resilient wall and the resilient wall is deflected and deformed outward. At this time, front and rear deflection supports of the resilient wall are pulled strongly by the partial locking projection and stress concentrates. In a worst case, the resilient wall may break.

The invention was completed based on the above situation and aims to provide a connector capable of ensuring a predetermined strength of a resilient wall defining a mounting hole that has a resilient wall.

SUMMARY

The invention is directed to a connector with a housing including a cavity. A mounting hole communicates with the cavity is open in one surface of the housing. A retainer is arranged in the mounting hole and includes a retaining portion for retaining a terminal fitting in the cavity. The retainer includes a locking protrusion projecting toward a surface of the housing intersecting with the one surface A part of the resilient wall of the mounting hole is capable of interfering with the locking protrusion and is disposed on the intersecting surface of the housing. The resilient wall includes a lock receiving portion for lockably receiving the locking protrusion by a resilient return of the resilient wall. An erroneous arrangement identifying portion is disposed on an inner surface of the mounting hole of the housing for restricting an erroneous arrangement of the retainer into the mounting hole. The erroneous arrangement identifying portion is a rib on the resilient wall. Thus, the strength of the resilient wall can be enhanced. The erroneous arrangement identifying portion has a function of reinforcing the resilient wall in addition to a function of restricting the erroneous arrangement of the retainer into the mounting hole. Thus, it is not necessary to provide a special reinforcing portion and a structure can be simplified by that much.

The resilient wall may have front and rear deflection supports. The erroneous arrangement identifying portion may be disposed on the side of one deflection support and a notch may be disposed on the side of the other deflection support. According to this configuration, a pulling force of the locking protrusion can be withstood by the erroneous arrangement identifying portion on the side of the one deflection support and the influence of the pulling of the locking protrusion can be suppressed to be small by the notch on the side of the other deflection support.

The notch may be disposed in the inner surface of the resilient wall. Thus, the resilient wall is deflected satisfactorily when being deflected and deformed outward when pressed by the locking protrusion since tensile stress acts in an opening direction of the notch.

A recess escaping from the locking protrusion may be disposed in the inner surface of the resilient wall and the erroneous arrangement identifying portion may define the recess. According to this configuration, the locking protrusion can escape into the recess, thereby avoiding interference between the locking protrusion and the resilient wall and preventing breakage of the resilient wall. Thus, a work burden in assembling the retainer with the housing is reduced. Additionally, the erroneous arrangement identifying portion defines the recess, and it is not necessary to provide a special reinforcing portion, thereby simplifying the structure.

DETAILED DESCRIPTION

One embodiment is described with reference to FIGS. 1 to 12. A connector of this embodiment includes a housing 10 and a retainer 60 to be mounted into the housing 10. The housing 10 is connectable to an unillustrated mating housing. Note that, in the following description, a surface side of the housing 10 facing the mating housing at the start of connection is referred to as a front side concerning a front-rear direction and a vertical direction is based on all the figures except FIGS. 7, 9 and 12. A width direction is a lateral direction of FIGS. 4 and 5.

Figure 1:
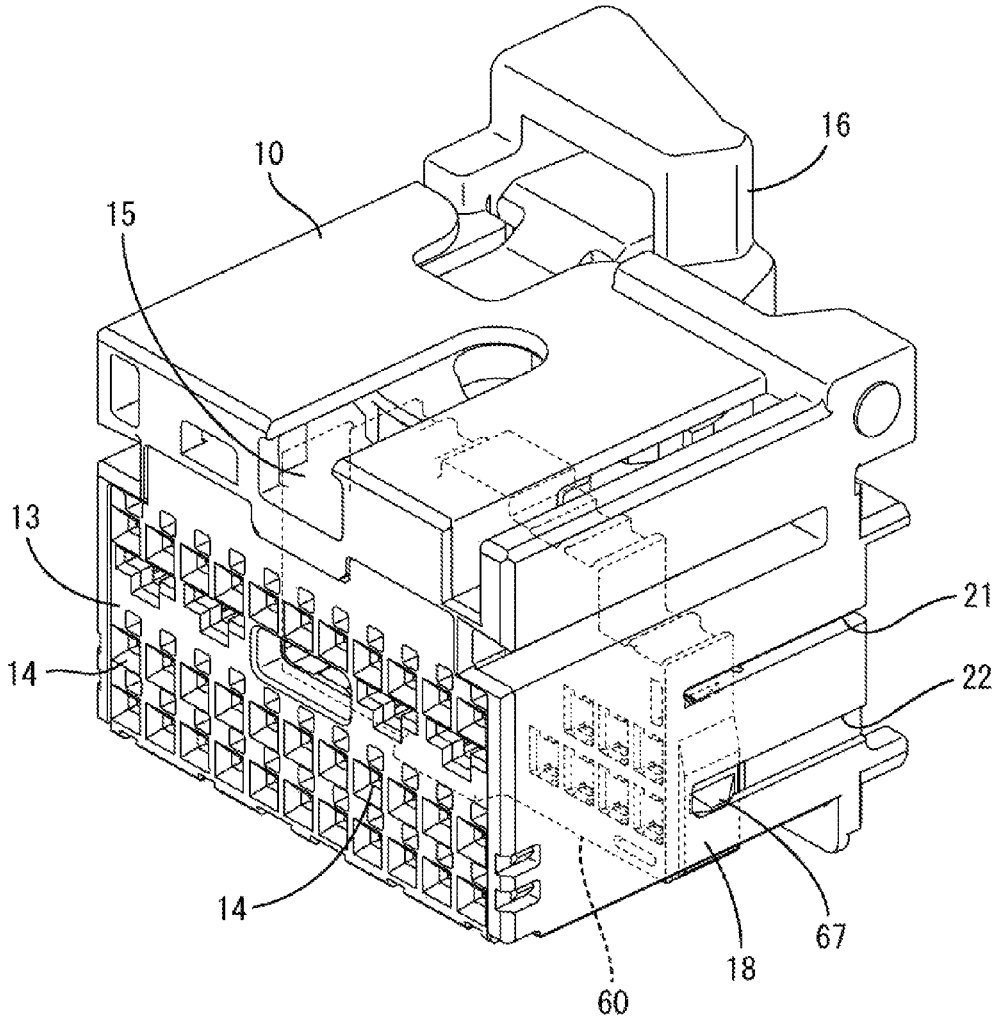
FIG. 1 is a perspective view showing a state where a retainer is held at a partial locking position with respect to a housing in a connector of one embodiment of the present invention.
Figure 12:
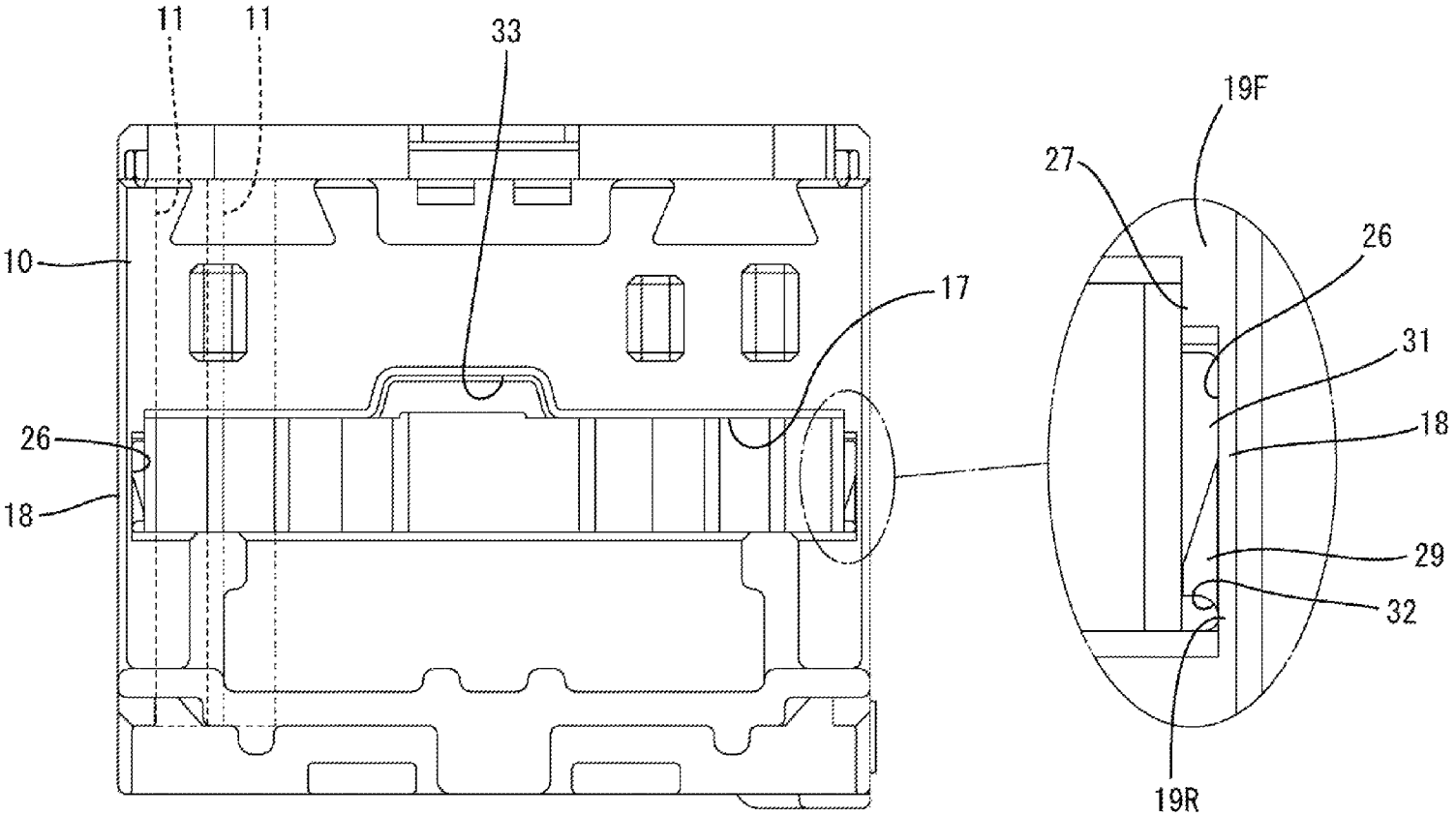
FIG. 12 is a bottom view of the housing.

The housing 10 is made of synthetic resin and, as shown in FIG. 1, is in the form of a rectangular block. Cavities 11 extend through the housing 10 in the front-rear direction, as shown in FIG. 12, and a terminal fitting 90 (see FIGS. 4 and 5) is inserted into each cavity 11 from behind. A deflectable locking lance 12 projects from an inner wall of each cavity 11 and locks the terminal fitting 90 for primarily retaining the properly inserted terminal fitting 90 in the cavity 11.

The front surface of the housing 10 is covered with a flat plate-shaped front mask 13, as shown in FIG. 1. The front mask 13 covers the locking lances 12 from the front to provide protection from external matter. The front mask 13 has tab insertion holes 14 at positions corresponding to the respective cavities 11 for receiving male tabs of the unillustrated mating housing.

A lever accommodating chamber 15 is provided in an upper end part of the housing 10. The lever accommodating chamber 15 is long and narrow in the width direction and open in the rear surface of the housing 10. A plate-shaped lever 16 is accommodated in the lever accommodating chamber 15. The lever 16 is cam-engaged with the mating housing and can be rotated to assist or cause a connecting operation of the housings.

Figure 6:
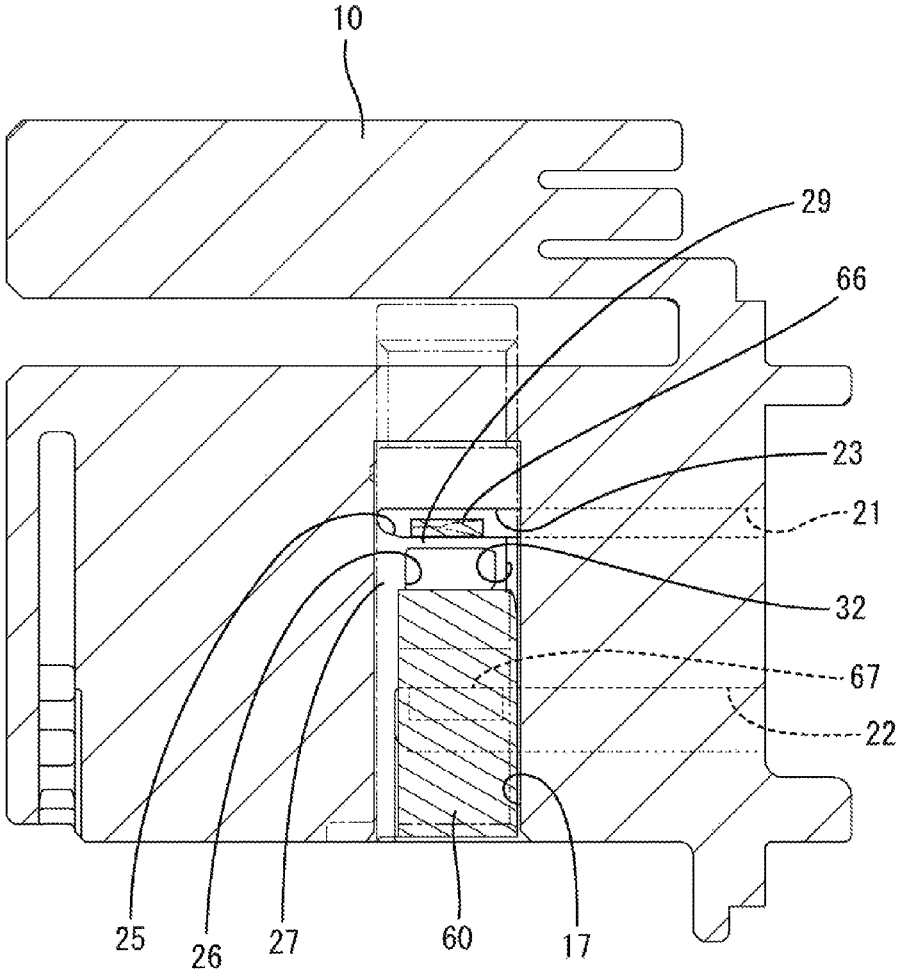
FIG. 6 is a side view in section corresponding to FIG. 3.

As shown in FIGS. 6 and 12, the housing 10 has a mounting hole 17 into which the retainer 60 is to be inserted. The mounting hole 17 is located behind the locking lances 12 and communicates with all the cavities 11. The mounting hole 17 is open in the lower surface (one surface) of the housing 10 and defines an opening that is long and narrow in the width direction.

Resilient walls 18 are disposed on both widthwise sides of the housing 10 and define opposite side surfaces of the mounting hole 17, as shown in FIG. 12. Each resilient wall 18 is a thin plate that is resiliently deformable with front and rear end parts serving as deflection supports 19F, 19R. An outer surface of the resilient wall 18 defines a flat side surface of the housing 10 and is continuous with a surrounding side surface part without a step (see FIGS. 1 to 3).

Figure 2:
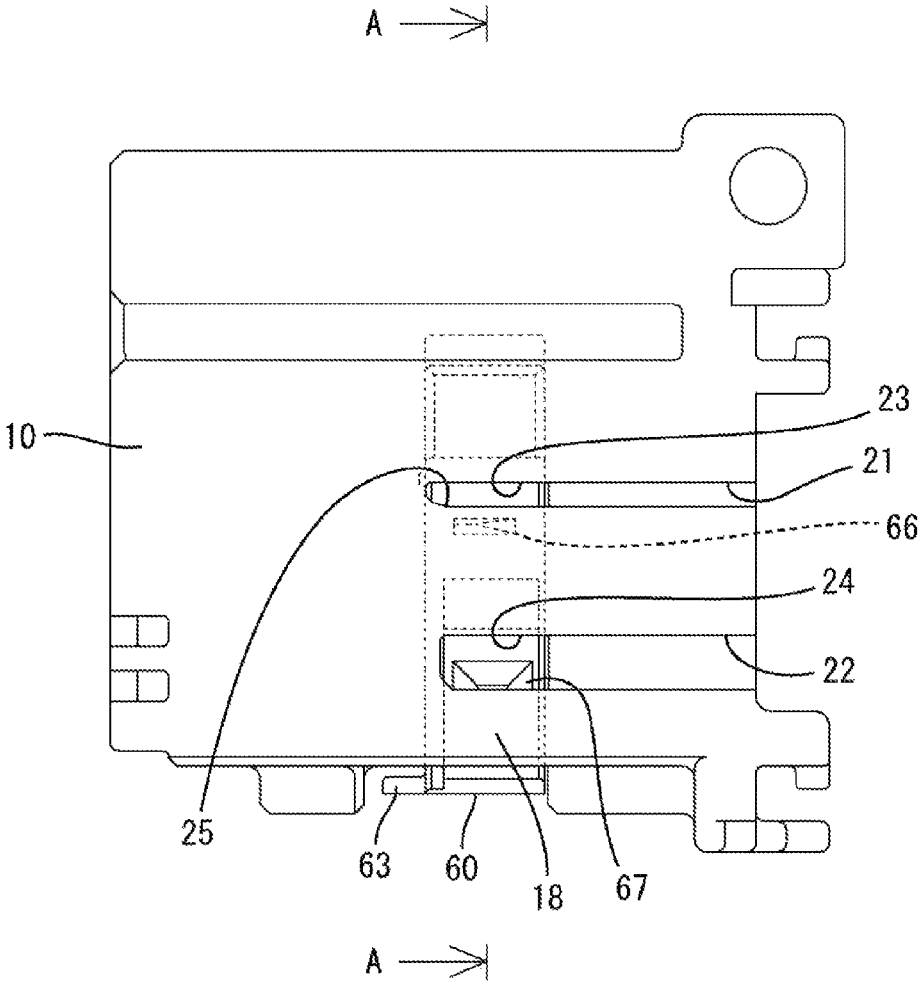
FIG. 2 is a side view showing the state where the retainer is held at the partial locking position with respect to the housing.
Figure 3:
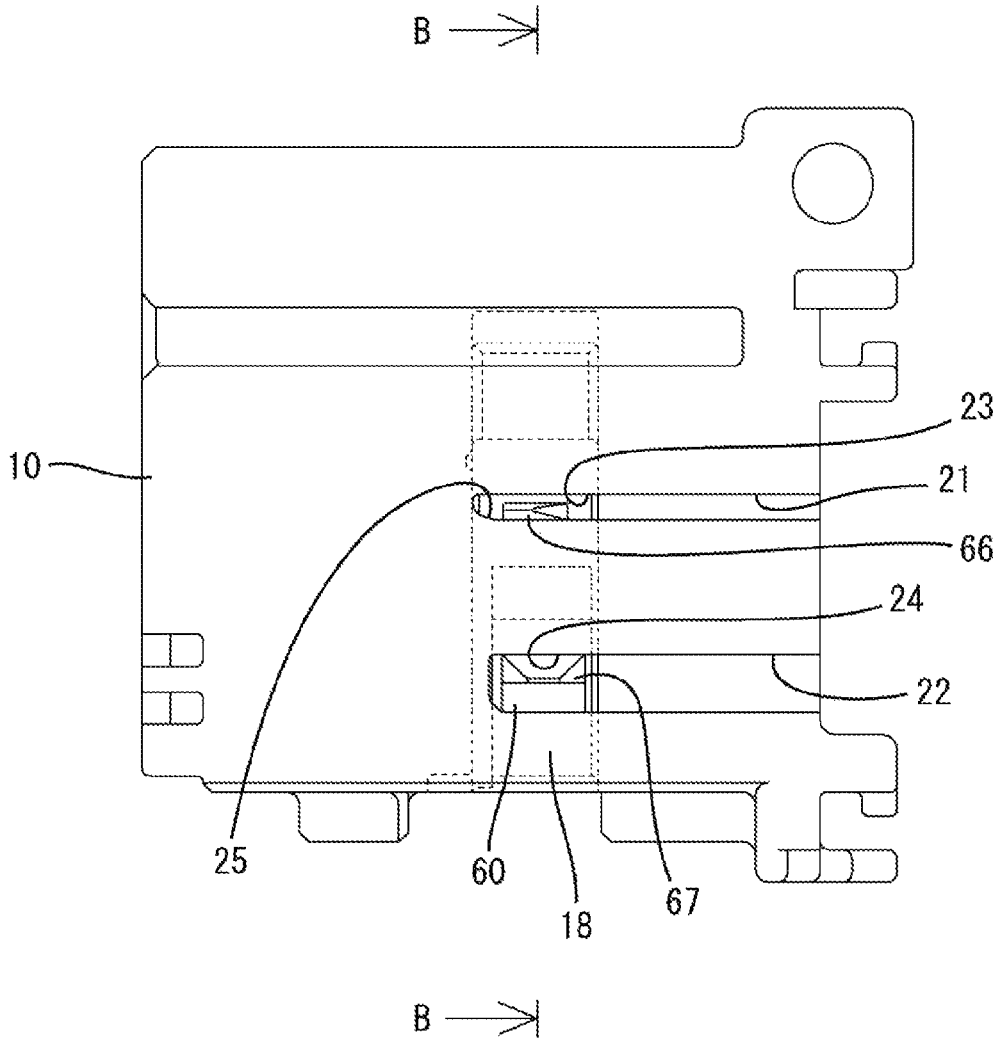
FIG. 3 is a side view showing a state where the retainer is held at a full locking position with respect to the housing.

As shown in FIGS. 1 to 3, a side surface of the housing 10 is recessed to form a first slit 21 and a second slit 22 extending parallel to the front-rear direction and open on the rear end of the housing 10. The first slit groove 21 is located on an upper side has a smaller vertical groove width than the second slit groove 22 located on a lower side. A depth of each of the first and second slit grooves 21, 22 is equal to a plate or wall thickness of the resilient wall 18.

As shown in FIGS. 2 and 3, a front part of the first slit groove 21 penetrates through the resilient wall 18 in the front-rear direction and defines a locking hole 23 that communicates with the mounting hole 17 in the width direction. Similarly, a front part of the second slit groove 22 penetrates through the resilient wall 18 in the front-rear direction and serves as a partial locking hole 24 communicating with the mounting hole 17 in the width direction. The front end of the locking hole 23 is slightly in front of the partial locking hole 24. The lower edge of a front end part of the locking hole 23 defines a curved portion 25 curved up toward the front end.

Opposite side surfaces of the mounting hole 17 are defined by the resilient walls 18, and the mounting hole 17 is open only in the lower surface of the housing 10. Thus, resin satisfactorily spreads to areas of the housing 10 at both front and rear sides of the mounting hole 17 via the resilient walls 18 during resin molding. As a result, a molding failure occurrence rate is low. Further, although the resilient walls 18 are present on both widthwise sides of the housing 10, these resilient walls 18 are thin and the retainer 60 does not project out from the side surface of the housing 10 when inserted into the mounting hole 17. Thus, a width of the connector is small, and it is possible to meet a request for the miniaturization of the connector.

Next, the structure of the inner surface of the resilient wall 18 is described. As shown in FIGS. 6 and 12, a downwardly open recess 26 is provided in the inner surface of the resilient wall 18. The recess 26 extends in the vertical direction while having a predetermined width in the front-rear direction. The width of the recess 26 in the front-rear direction is larger than that of a later-described locking protrusion 66 of the retainer 60 and a depth of the recess 26 is equal to or slightly larger than a projecting dimension of the locking protrusion 66.

A center of the recess 26 in the front-rear direction is deviated rearward from a center of the inner surface of the resilient wall 18 in the front-rear direction. The front end of the recess 26 is located behind a front end of the resilient wall 18 (front surface of the mounting hole 17). An area of the inner surface of the resilient wall 18 in front of the recess 26 serves as a rib-like (rectangular column-like) erroneous arrangement identifying portion 27 extending in the vertical direction. The erroneous arrangement identifying portion 27 defines the front end of the recess 26 and has a lower end located at the lower surface of the housing 10.

Figure 4:
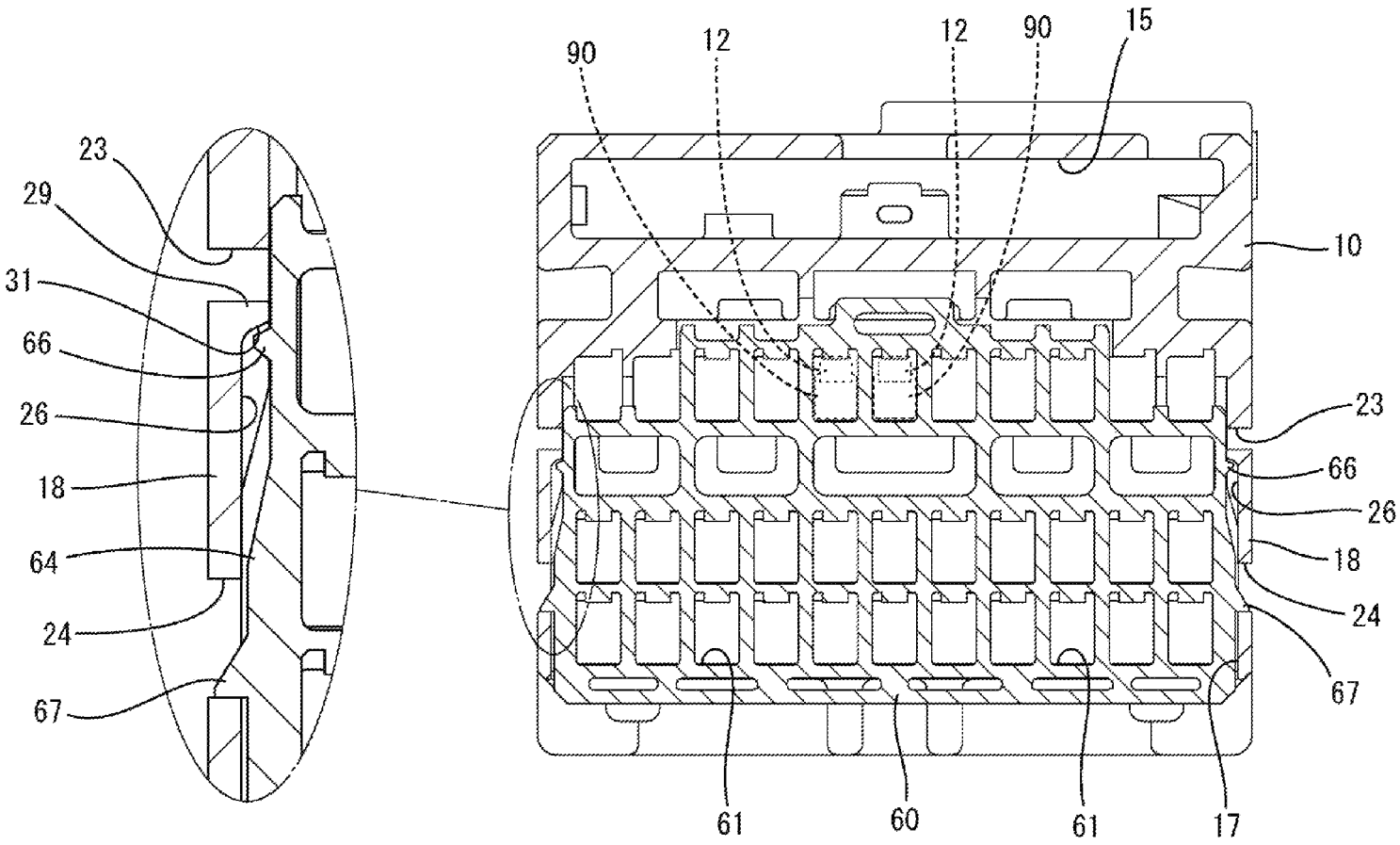
FIG. 4 is a section along A-A of FIG. 2.
Figure 5:
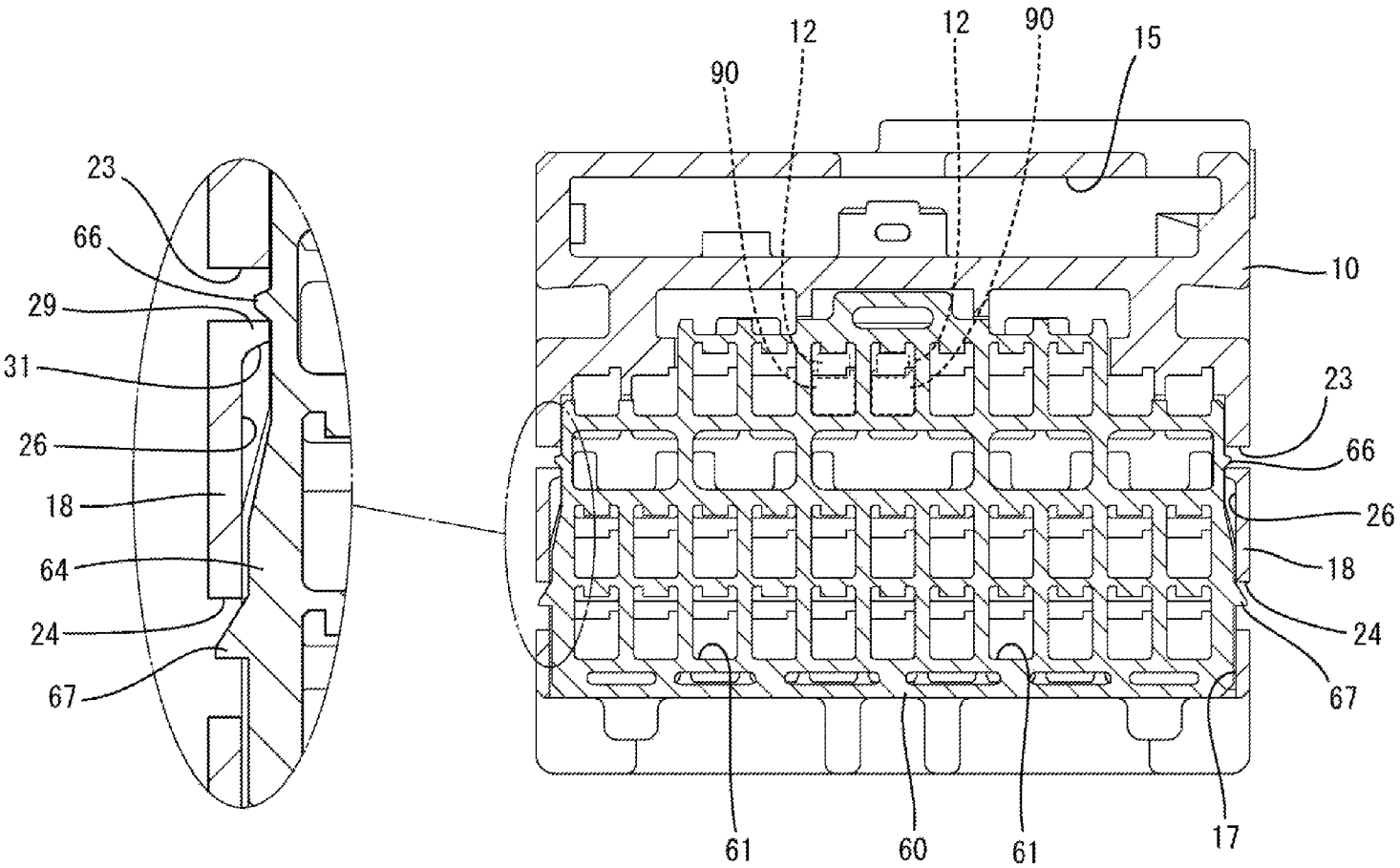
FIG. 5 is a section along B-B of FIG. 3.

The recess 26 is located below the locking hole 23 and a rib-like interfering portion 29 extending along the front-rear direction is interposed between the recess 26 and the locking hole 23. The upper surface of the interfering portion 29 constitutes the lower surface of the locking hole 23 (including the curved portion 25) and is arranged along the width direction. As shown in FIGS. 4 and 5, the lower surface of the interfering portion 29 constitutes the upper surface of the recess 26 and includes a slope 31 inclined up. As shown in FIG. 12, the slope 31 is shaped to correspond to the locking projection 66 of the retainer 60.

As shown in FIG. 12, a front part of the interfering portion 29 intersects with and is connected to the erroneous arrangement identifying portion 27. A rear part of the interfering portion 29 is at a position corresponding to the rear deflection support 19R of the resilient wall 18, and a notch 32 extending in the vertical direction is recessed on this rear end part. The notch 32 has a recessed cross section and extends to vertically cut the interfering portion 29. Note that the partial locking hole 24 is open in the back surface (bottom surface) of the recess 26.

Next, the structure of the retainer 60 is described. The retainer 60 is made of synthetic resin, and is in the form of a plate. As shown in FIGS. 1 to 3, the retainer 60 is inserted into the mounting hole 17 from below the housing 10 with a plate thickness direction aligned with the front-rear direction. The retainer 60 is movable between a partial locking position (see FIGS. 1, 2 and 4) and a full locking position (see FIGS. 3, 5 and 6) located above the partial locking position with respect to the housing 10.

Figure 8:
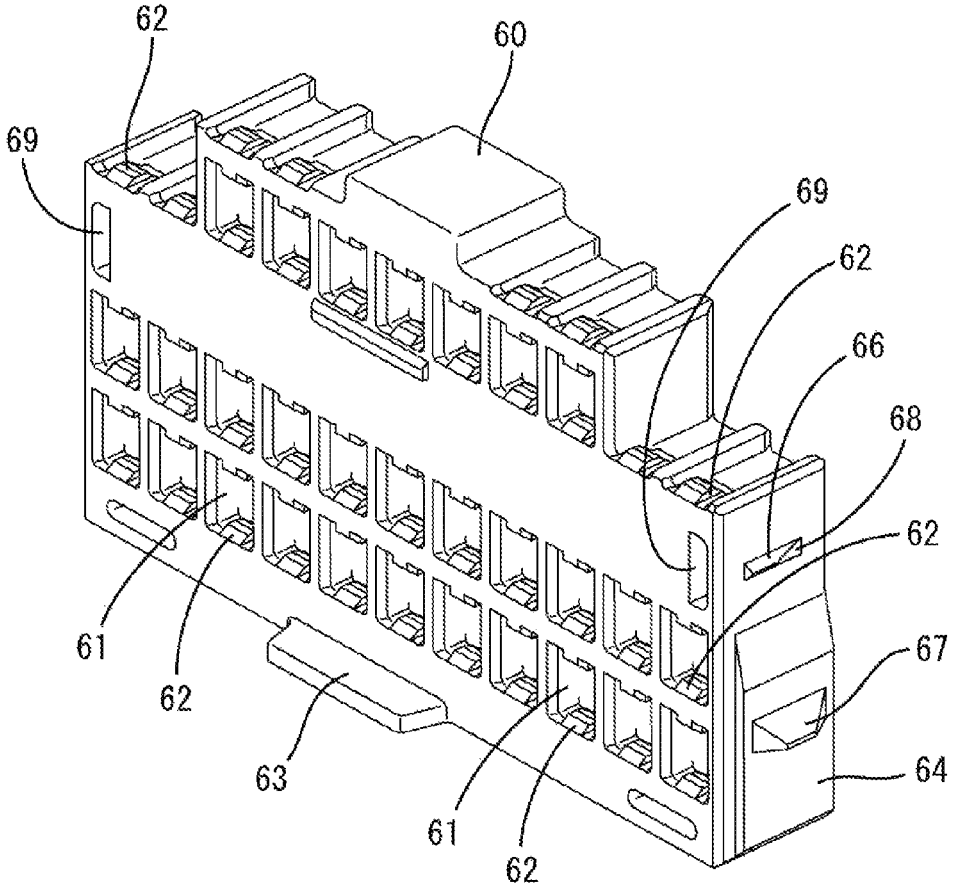
FIG. 8 is a perspective view of the retainer.
Figure 10:
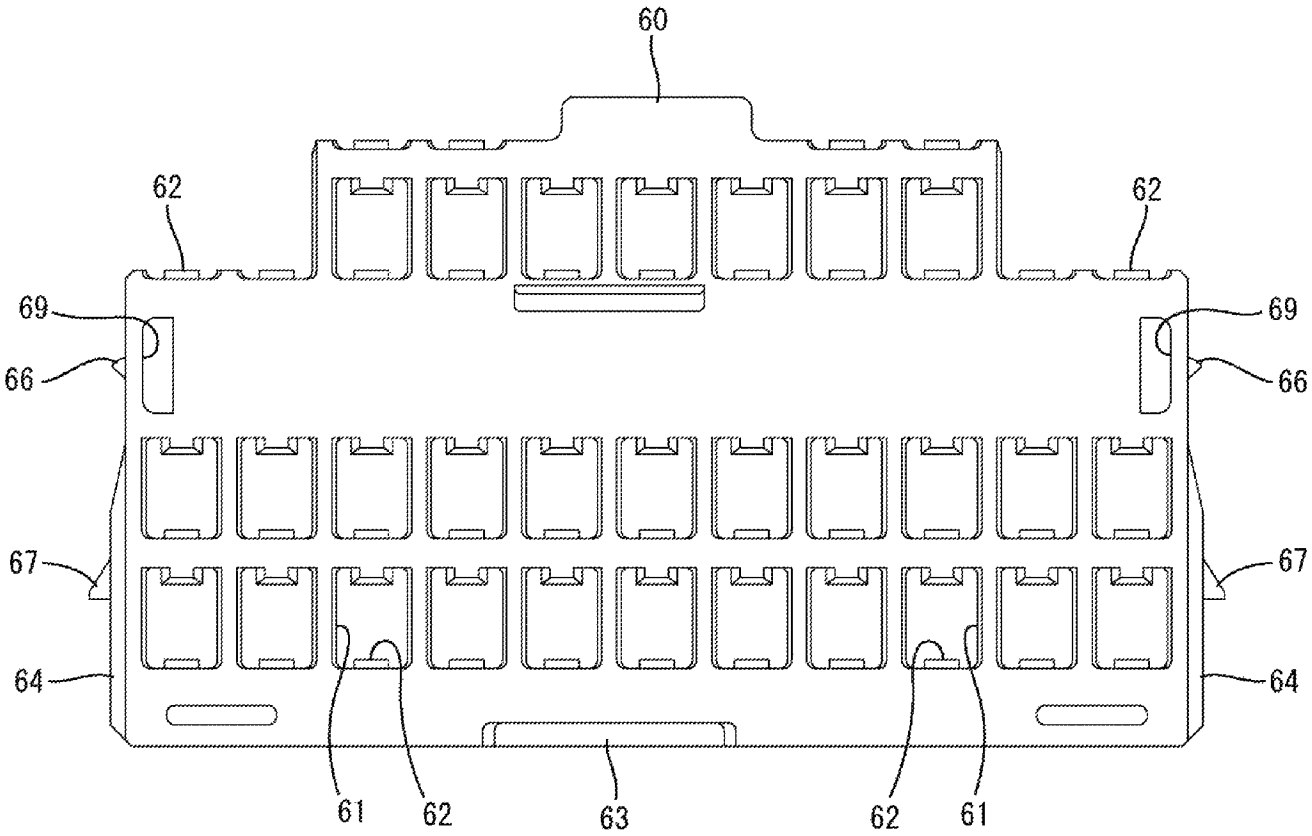
FIG. 10 is a front view of the retainer.

The retainer 60 includes through holes 61 at positions corresponding to the respective cavities 11. As shown in FIGS. 8 and 10, each through hole 61 has a substantially rectangular cross-section and can accommodate the terminal fitting 90. A retaining portion 62 projects from the lower surface of each through hole 61 and retaining portions 62 also project from the upper end surface of the retainer 60. The respective retaining portions 62 are retracted down from the cavities 11 when the retainer 60 is at the partial locking position so that the terminal fittings 90 can be inserted into the cavities 11. The respective retaining portions 62 enter the cavities 11 and lock the terminal fittings 90 when the retainer 60 is at the full locking position so that the terminal fittings 90 cannot come out of the cavities 11.

Figure 7:
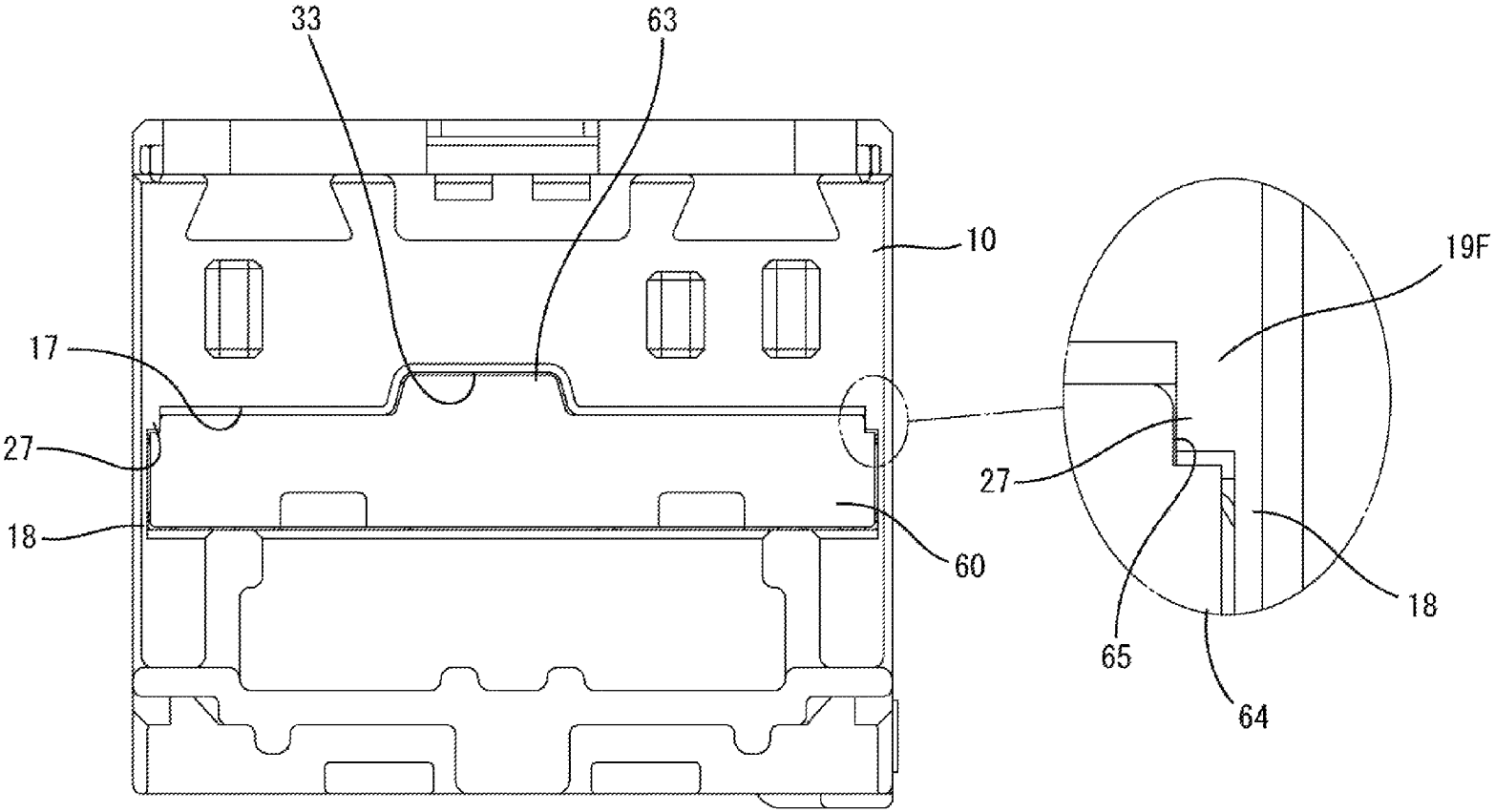
FIG. 7 is a bottom view of the connector.

A projecting piece 63 projects forward on a lower end side of a widthwise central part of the front surface of the retainer 60. As shown in FIG. 7, the projecting piece 63 is arranged along the width direction and fittable into a projecting piece receiving portion 33 in the form of a shallow recess in the lower surface of the housing 10.

Figure 9:
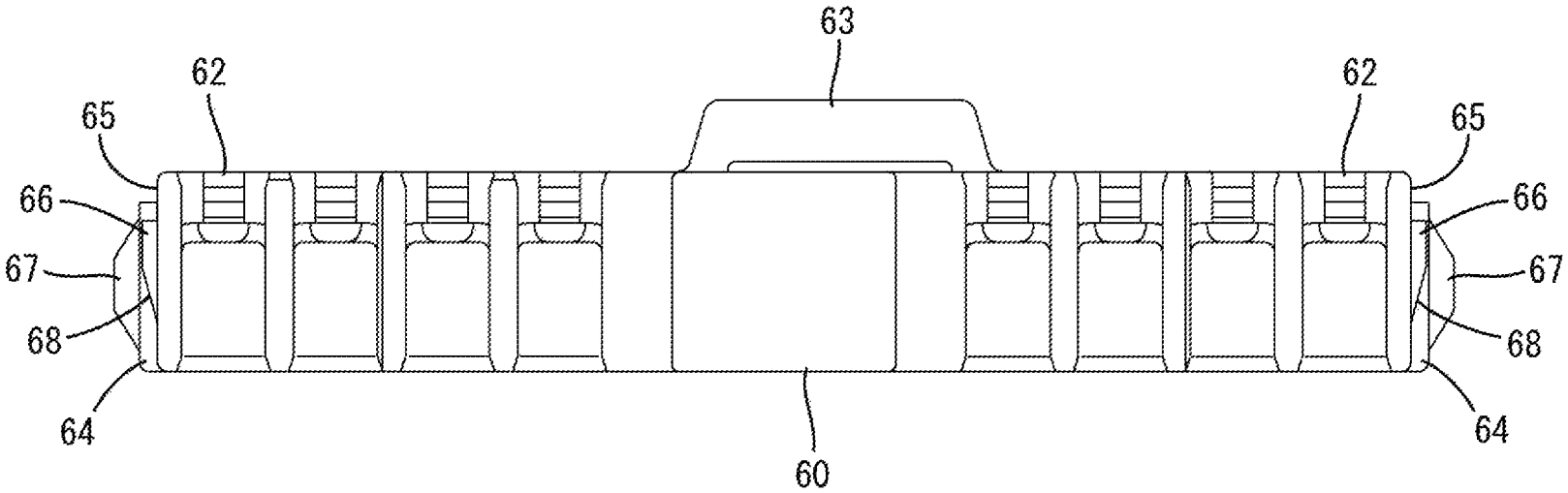
FIG. 9 is a plan view of the retainer.

As shown in FIGS. 8 to 10, raised base portions 64 having flat trapezoidal shapes are formed on lower parts of both side surfaces of the retainer 60. A receiving portion 65 capable of receiving the erroneous arrangement identifying portion 27 and having a substantially L-shaped cross-section is formed between the front surface of the base portion 64 and an area of each side surfaces of the retainer 60 in front of the front surface of the base portion 64, as shown in FIG. 7.

Further, the locking protrusion 66 and a partial locking protrusion 67 are provided vertically side by side on each of the side surfaces of the retainer 60. The partial locking protrusion 67 projects from a flat surface of the base portion 64. A projecting tip of the partial locking protrusion 67 is outward of the locking protrusion 66 in the width direction.

Each of the partial locking protrusion 67 and the locking protrusion 66 is in the form of a rib extending in the front-rear direction, and the partial locking protrusion 67 is slightly larger than the locking protrusion 66. Front ends of the partial locking protrusion 67 and the locking protrusion 67 are at substantially the same position in the front-rear direction. On the other hand, the rear end of the partial locking protrusion 67 is behind that of the locking protrusion 66.

As shown in FIG. 10, the upper surface of the partial locking protrusion 67 is inclined down toward the projecting tip and the lower surface thereof is substantially horizontal. As shown in FIG. 9, the front surface of the partial locking protrusion 67 is inclined rearward toward the projecting tip and the rear surface is inclined forwardly toward the projecting tip.

As shown in FIG. 10, the upper surface of the locking protrusion 66 is inclined down toward the projecting tip, and the lower surface is inclined up toward the projecting tip. Angles of inclination with respect to the width direction are set such that the lower surface of the locking protrusion 66 is steeper than the upper surface of the locking protrusion 66. The projecting tip of the locking protrusion 66 has a pointed shape extending along the front-rear direction.

Figure 11:
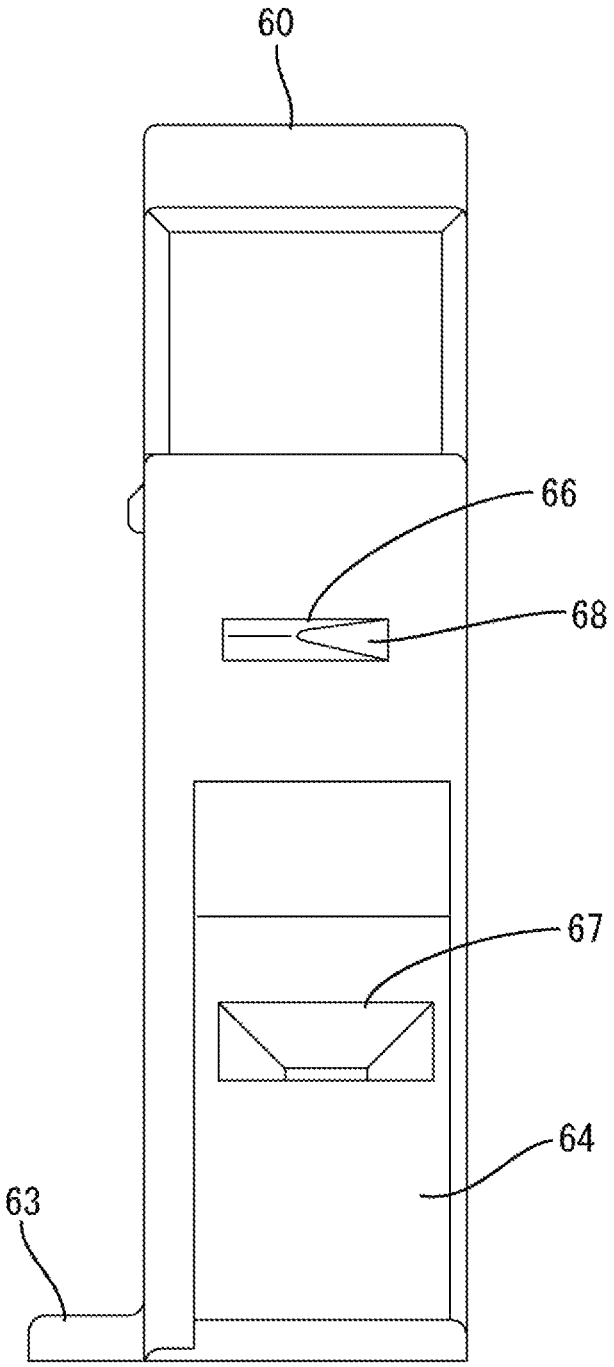
FIG. 11 is a side view of the retainer.

As shown in FIG. 9, the front surface of the locking protrusion 66 is substantially vertical. On the other hand, the rear surface of the locking protrusion 66 forms an escaping surface 68 inclined a large amount forward toward the projecting tip. As shown in FIG. 11, the front end of the escaping surface 68 is near a center of the locking protrusion 66 in the front-rear direction.

A displacement allowing hole 69 penetrate through an area of the retainer 60 inward of the locking protrusion 66 in the width direction. The displacement allowing hole 69 is long in the vertical direction and allows the locking protrusion 66 to be displaced resiliently.

Next, functions and effects of the connector of this embodiment are described.

First, the retainer 60 is inserted into the mounting hole 17 of the housing 10 from below. In the process of inserting the retainer 60, the erroneous arrangement identifying portions 27 are inserted in the receiving portions 65 and the locking protrusions 66 are inserted into the recesses 26 to escape, thereby avoiding the interference of the locking protrusions 66 and the resilient walls 18. As the retainer 60 is inserted farther, the partial locking protrusions 67 slide on the back surfaces of the recesses 26 and lower end parts of the resilient walls 18 are deflected and deformed out. As the retainer 60 is inserted farther, the resilient walls 18 resiliently return and the partial locking protrusions 67 are fit into the partial locking holes 24 from inside, with the retainer 60 at the partial locking position. At this time, as shown in FIGS. 2 and 4, the partial locking protrusions 67 contact with the lower surfaces of the partial locking holes 24 to restrict a downward displacement of the retainer 60 in a direction to come out of the mounting hole 27.

When the retainer 60 reaches the partial locking position, the locking protrusions 66 are located on upper ends of the recesses 26 and contact the slopes 31 of the interfering portions 29 from below, thereby restricting an upward displacement of the retainer 60 toward the full locking position.

On the other hand, if the retainer 60 is in an improper posture, such as a front-rear reversed posture with respect to the housing 10, upper corners of the retainer 60 contact the lower surfaces of the erroneous arrangement identifying portions 27 to obstruct insertion of the retainer 60 into the mounting hole 17. Thus, an improper posture of the retainer 60 is detected and an assembling operation of the retainer 60 is performed again.

Each terminal fitting 90 is inserted into the cavity 11 and primarily retained by the locking lance 12 after the retainer 60 is inserted in a proper posture into the mounting hole 17 and reaches the partial locking position. Subsequently, the retainer 60 is pushed toward the full locking position. Here, if any one of the respective terminal fittings 90 is not inserted to a proper depth into the cavity 11, the inserting operation of the retainer 60 is restricted thereby indicating that at least one of the terminal fitting 90 is inserted incompletely.

The upper surfaces of the locking protrusions 66 slide on the slopes 31 of the interfering portions 29 and parts of the resilient walls 18 corresponding to the interfering portions 29 are deflected and deformed outward as the retainer 60 moves to the full locking position. At this time, the front and rear deflection supports 19F, 19R of the resilient walls 18 (interfering portions 29) are pulled by the locking protrusions 66 and stress concentrates there. However, the front deflection supports 19F are reinforced by the rib-like erroneous arrangement identifying portions 27 and can withstand strong pulling forces by the locking protrusions 66. Further, the escaping surfaces 68 of the locking protrusions 66 are shaped to escape from the rear deflection supports 19R to suppress having the rear deflection supports 19R pulled strongly by the locking protrusions 66. Furthermore, since the notches 32 allow resilient displacements of the rear deflection supports 19R, the rear deflection supports 19R are less likely to be affected by the pulling of the locking protrusions 66. Thus, even if the resilient walls 18 are deflected and deformed outward by being pressed by the locking protrusions 66 as the retainer 60 moves toward the full locking position, there is substantially no possibility that the resilient walls 18 will break.

When the retainer 60 reaches the full locking position, the resilient walls 18 resiliently return and the locking protrusions 66 are fit into the locking holes 23 from inside. At this time, as shown in FIGS. 3 and 5, the locking protrusions 66 come into contact with the lower surfaces of the locking holes 23, thereby restricting a downward displacement of the retainer 60 to the partial locking position. Further, the projecting piece 63 is fit to come into contact with the projecting piece receiving portion 33, thereby restricting a displacement of the retainer 60 farther up than the full locking position. At the full locking position, the retaining portions 62 are inserted in the cavities 11 and lock the terminal fittings 90 secondarily. Note that wires connected to the respective terminal fittings 90 are pulled out through the rear surface of the housing 10. Thereafter, the connector is connected to the mating housing by rotating the lever 16.

As described above, since the erroneous arrangement identifying portion 27 is a rib-like part provided on the resilient wall 18, the strength of the resilient wall 18 can be enhanced. In this case, the erroneous arrangement identifying portion 27 has a function of reinforcing the resilient wall 18 in addition to a function of restricting an erroneous arrangement (erroneous assembling) of the retainer 60 into the mounting hole 17. Thus, it is not necessary to provide a special reinforcing portion and the structure can be simplified by that much.

Further, the erroneous arrangement identifying portion 27 is disposed on the side of the front deflection support 19F of the resilient wall 18 and the notch 32 is disposed on the side of the rear deflection support 19R of the resilient wall 18. Thus, when the resilient wall 18 is deflected and deformed out by being pressed by the locking protrusion 66, the resilient wall 18 can withstand the pulling force of the locking protrusion 66 by the erroneous arrangement identifying portion 27 at the front deflection support 19F and the influence of the pulling of the locking protrusion 66 can be suppressed to be small by the notch 32 at the rear deflection support 19R. As a result, a situation where the resilient wall 18 is not likely to be broken.

The notch 32 is disposed in the inner surface of the resilient wall 18. Thus, tensile stress acts in an opening direction of the notch 32 and the resilient wall 18 is deflected satisfactorily when the resilient wall 18 is deflected and deformed out by being pressed by the locking protrusion 66.

Furthermore, the recess 26 is disposed in the inner surface of the resilient wall 18, and the locking protrusion 66 is allowed to escape into the recess 26 so that interference with the resilient wall 18 can be avoided until the retainer 60 reaches the full locking position. Thus, a resilient displacement of the resilient wall 18 is suppressed, the breakage of the resilient wall 18 can be prevented, and a work burden in assembling the retainer 60 with the housing 10 can be reduced. Further, since the front end of the recess 26 is defined by the erroneous arrangement identifying portion 27 rather than by a special defining portion, the structure can be simplified.

Other embodiments of the present invention are briefly described.

In the above embodiment, the locking protrusions and the partial locking protrusions may be switched and the locking protrusions may be inserted into the partial locking holes to be lockable to the housing when the retainer is at the partial locking position.

The tips of the locking protrusions may slide on the back surfaces of the recesses until the retainer reaches the full locking position.

The recess may not be provided in the inner surface of the resilient wall.

Converse to the above embodiment, the erroneous arrangement identifying portion may be disposed at the rear deflection support of the resilient wall and the notch may be disposed at the front deflection support of the resilient wall.

LIST OF REFERENCE SIGNS

10 . . . housing
11 . . . cavity
17 . . . mounting hole
18 . . . resilient wall
19F . . . front deflection support point
19R . . . rear deflection support point
26 . . . recess
27 . . . erroneous arrangement identifying portion
32 . . . notch
60 . . . retainer
62 . . . retaining portion
66 . . . locking protrusion
67 . . . partial locking protrusion
90 . . . terminal fitting

What is claimed is:

1. A connector, comprising:

a housing (10) including a cavity (11) and a mounting hole (17) communicating with the cavity and open in one surface of the housing (10); and a retainer (60) to be arranged in the mounting hole (17) and including a retaining portion for retaining a terminal fitting (90) in the cavity (11), wherein:

the retainer (60) includes a locking protrusion (66) projecting toward a surface of the housing intersecting with the one surface;

a resilient wall (18) disposed on the intersecting surface of the housing (10) and defining at least part of the mounting hole (17), the resilient wall (18) including a part capable of interfering with the locking protrusion (66) is;

the resilient wall (18) includes a lock receiving portion (23) for lockingly receiving the locking protrusion (66) by resilient return of the resilient wall (18);

an erroneous arrangement identifying portion (27) disposed on an inner surface of the mounting hole (17) of the housing (10) for restricting an erroneous arrangement of the retainer (60) into the mounting hole (17); and the erroneous arrangement identifying portion (27) is a rib-like part provided on the resilient wall (18).

2. The connector of claim 1, wherein, the resilient wall (18) has front and rear deflection supports (19F, 19R), the erroneous arrangement identifying portion (27) is disposed on the side of one deflection support (19F) and a notch (32) is disposed on the side of the other deflection support (19R).

3. The connector of claim 2, wherein the notch (32) is disposed in an inner surface of the resilient wall (18).

4. The connector of claim 1, wherein a recess (26) escaping from the locking protrusion (66) is disposed on an inner surface of the resilient wall (18) and the erroneous arrangement identifying portion (27) defines the recess.

* * * * *